US006507261B1

(12) United States Patent
Haga et al.

(10) Patent No.: US 6,507,261 B1
(45) Date of Patent: Jan. 14, 2003

(54) COIL BOBBIN FOR CURRENT TRANSFORMER

(75) Inventors: Yuji Haga, Saitama (JP); Yoshihiro Katano, Saitama (JP); Kohei Okano, Saitama (JP)

(73) Assignee: Tamura Corporation, Tokyo (JP)

( * ) Notice: Subject to any disclaimer, the term of this patent is extended or adjusted under 35 U.S.C. 154(b) by 17 days.

(21) Appl. No.: 09/712,713

(22) Filed: Nov. 14, 2000

(30) Foreign Application Priority Data

Aug. 21, 2000 (JP) ..... 2000-249297

(51) Int. Cl.[7] ..... H01F 27/30

(52) U.S. Cl. ..... 336/198; 336/192; 336/198; 336/208

(58) Field of Search ..... 336/192, 198, 336/208; 242/118.41

(56) References Cited

U.S. PATENT DOCUMENTS 4,010,435 A * 3/1977 Shigehara et al. ..... 336/192
4,617,543 A * 10/1986 Akachi ..... 336/192

FOREIGN PATENT DOCUMENTS

GB 002333646 A * 7/1999
JP 03180009 A 8/1991
JP 4-105525 9/1992

* cited by examiner

*Primary Examiner*—Lincoln Donovan
*Assistant Examiner*—Jennifer A Poker
(74) *Attorney, Agent, or Firm*—Dennis G. LaPointe; Mason Law, P.A.

(57) ABSTRACT

A coil bobbin for a current transformer is provided which requires no adhesive and no eyelets, as well as enables easy fixing of a primary coil to the coil bobbin without an increase in cost. The coil bobbin includes a configuration in which a coil bobbin 1 is formed, at an outer surface of one of flanges 4 thereof, with a primary coil mounting portion 7 and a primary coil fixing portion 8 so as to protrude outwardly. The primary coil mounting portion 7 and the primary coil fixing portion 8 are formed, at both sides thereof, with through holes 9, 9' through which a pair of legs 3*a* of a primary coil 3 for detecting electric current extend. The primary coil fixing portion 8 is formed with a window 12 into which a jig is inserted. The window 12 is formed with concave fixing portions 12*a*. Each of the legs 3*a* of the primary coil 3 is inserted into the through hole 9 of the primary coil mounting portion 7, then the window 12 and the through hole 9' of the primary coil fixing portion 8, respectively; and each of the legs 3*a* positioned in the window 12 is bent by the jig toward each of the fixing portions 12*a* to be fixed thereto.

8 Claims, 7 Drawing Sheets

COIL BOBBIN FOR CURRENT TRANSFORMER

BACKGROUND OF THE INVENTION

1. Field of the Invention

The present invention relates to a coil bobbin for a current transformer, which is incorporated into a microwave oven, an air conditioner, an electromagnetic cooking device or the like so as to be used in an electric current detecting portion of a circuit in a machine.

2. Description of Related Art

Conventionally, as shown in FIG. 8, this kind of current transformer is, for example, configured so as to have a primary coil 20 for detecting electric current, a coil bobbin 21 into which the primary coil 20 is incorporated, a secondary coil 22 wound around a winding drum of the coil bobbin 21, pin terminals 23 to which lead wires of the secondary coil 22 are connected, and a core 24 incorporated into the coil bobbin 21 including the primary coil 20 and the secondary coil 22, or the like.

In this current transformer, the primary coil 20 is formed from a thick CP wire or a copper wire to be bent in substantially U-shape, and inserted into a through hole 25 of the coil bobbin 21 to be incorporated into the coil bobbin 21.

In this case, for example, adhesive is used for fixing the primary coil 20 to the coil bobbin 21.

Alternatively, an eyelet 26 is mounted on each a pair of legs 20*a* of the primary coil 20, protruding from the bottom surface of the coil bobbin 21.

Another alternative is molding the primary coil 20 at the same time as molding the coil bobbin 21.

Using adhesive for fixing the primary coil 20 to the coil bobbin 21 has such defects that it takes too long in working process and that work control is hard to carry out.

Using the eyelets 26 has such defects that it causes an increase in the number of components and therefore in cost, and that a step of incorporating them is required.

Molding the primary coil 20 at the same time as molding the coil bobbin 21 has also such a defect that the molded component is expensive.

The present invention is achieved in view of the above and has its object to provide a coil bobbin for a current transformer which requires no adhesive or eyelets, and enables easy fixing of the primary coil to the coil bobbin without an increase in cost.

SUMMARY OF THE INVENTION

The present invention attains the above-described object according to a configuration wherein:

a coil bobbin 1 is formed with a primary coil mounting portion 7 and a primary coil fixing portion 8 at an outer surface of one of flanges 4 so as to protrude outwardly;

through holes 9, 9' are formed at both sides of the primary coil mounting portion 7 and the primary coil fixing portion 8 respectively, and a pair of legs 3*a* of a primary coil 3 for detecting electric current extend through the through holes 9, 9';

the primary coil fixing portion 8 is formed with a window 12 into which a jig is inserted;

the window 12 is formed with concave fixing portions 12*a*, each of the legs 3*a* of the primary coil 3 is inserted into the through hole 9 of the primary coil mounting portion 7, the window 12 and the through hole 9' of primary coil fixing portion 8, respectively; and each of the legs 3*a* positioned in the window 12 is bent by the jig toward each of the fixing portions 12*a* to be fixed thereto.

In this case, the fixing portions 12*a* are formed at both side surfaces of the window 12.

Alternatively, the window 12 is formed, at a center thereof, with a column 8*a*, which is formed, at both side surfaces thereof, with the fixing portions 12*a*.

Alternatively, the window 12 is formed, at an inner surface thereof, with the fixing portions 12*a*.

In addition, positioning members 10 for positioning the primary coil 3 are formed at a top surface of the primary coil mounting portion 7, and a wall 11 formed at each of both ends of the primary coil mounting portion 7.

Moreover, the jig 14 is formed with a protrusion 14*b*, 14*c*, 14*d* whereby each leg 3*a* mounted to the coil bobbin 1 and positioned in the window 12 is partly urged to be bent.

Furthermore, a top of the jig 14 is bent in substantially L-shape to be formed, at its bent portion 14*a*, with the protrusion 14*b*, 14*c*, 14*d* in substantially V-shape.

DETAILED DESCRIPTION OF THE PREFERRED EMBODIMENTS

In the present invention, a primary coil 3 is inserted into a coil bobbin 1 to be mounted. The coil bobbin 1 is formed with a window 12, which is formed with a concave fixing portion 12*a*. A pair of legs 3*a* of the primary coil 3 positioned in the window 12 are bent toward the fixing portion 12*a* by externally inserting a jig 14 into the window 12, thereby permitting easy fixing.

Embodiment 1

Figure 1:
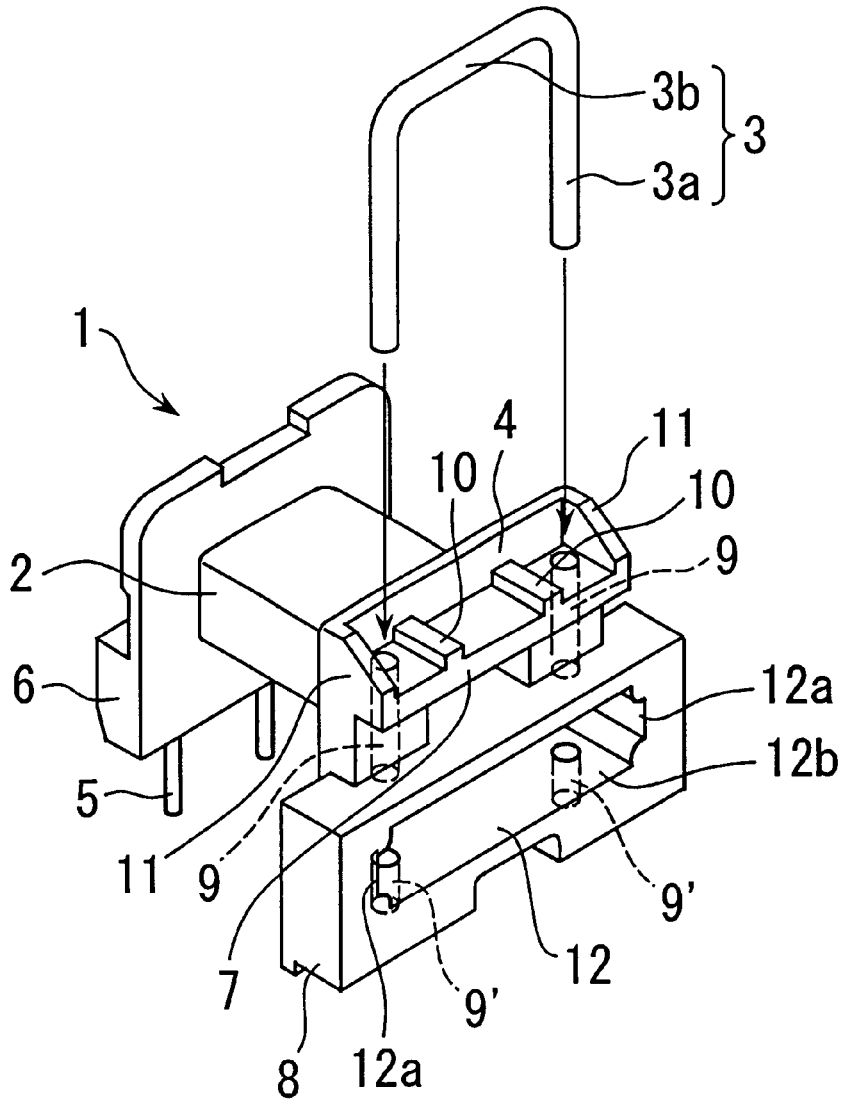
FIG. 1 is a disassembled perspective view showing a first embodiment of the present invention.
Figure 2:
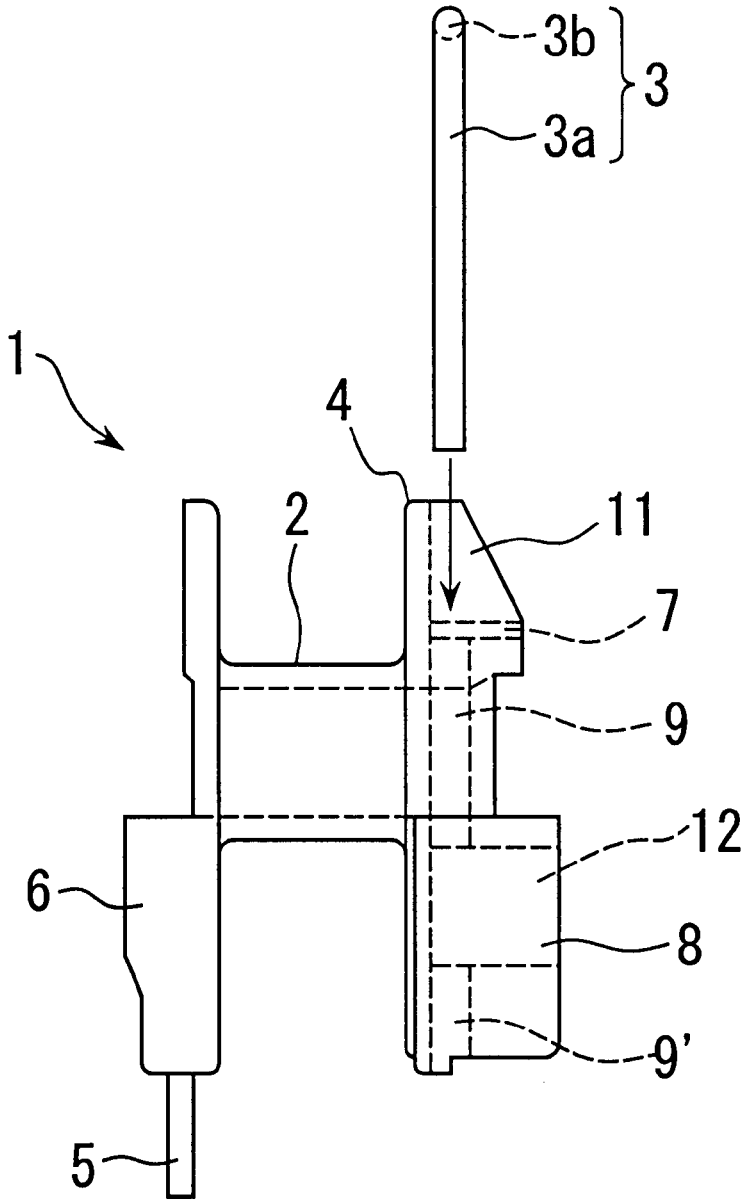
FIG. 2 is a side view showing the first embodiment of the present invention.
Figure 3:
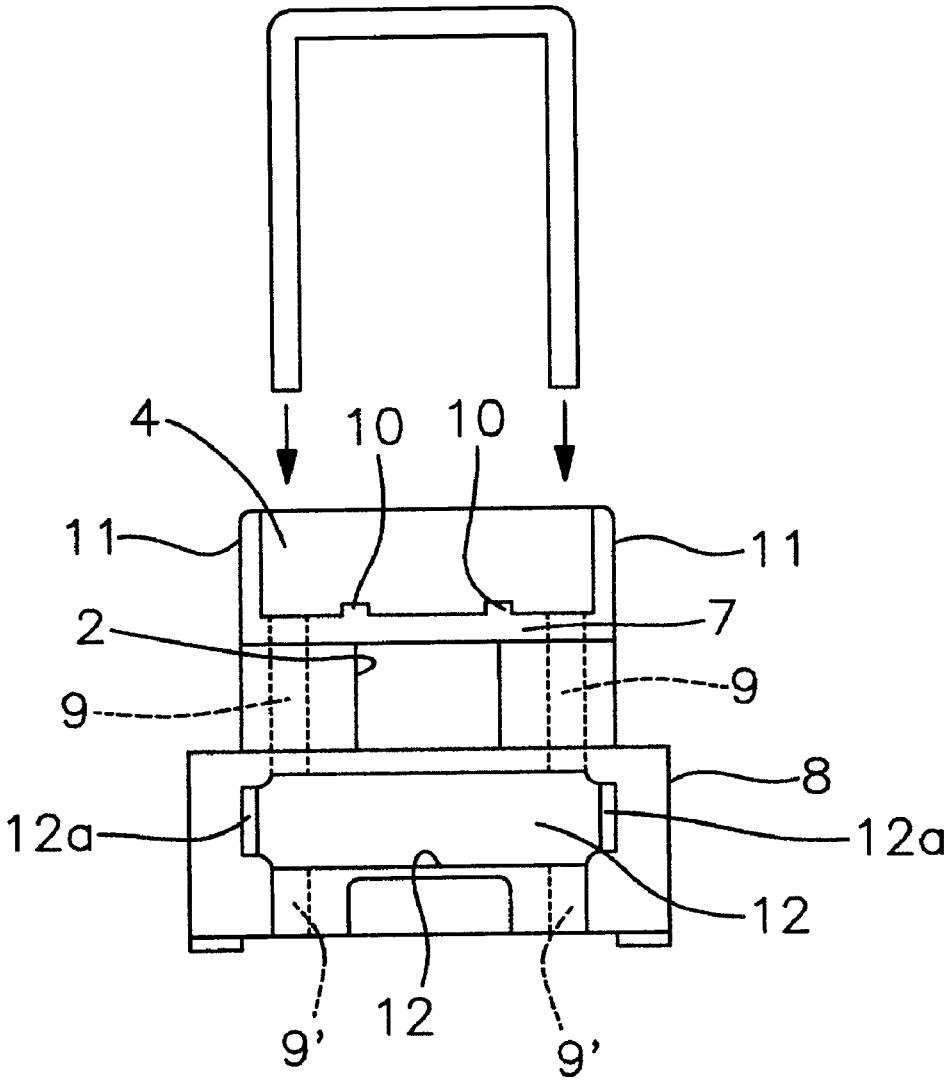
FIG. 3 is a front view showing the first embodiment of the present invention.
Figure 4:
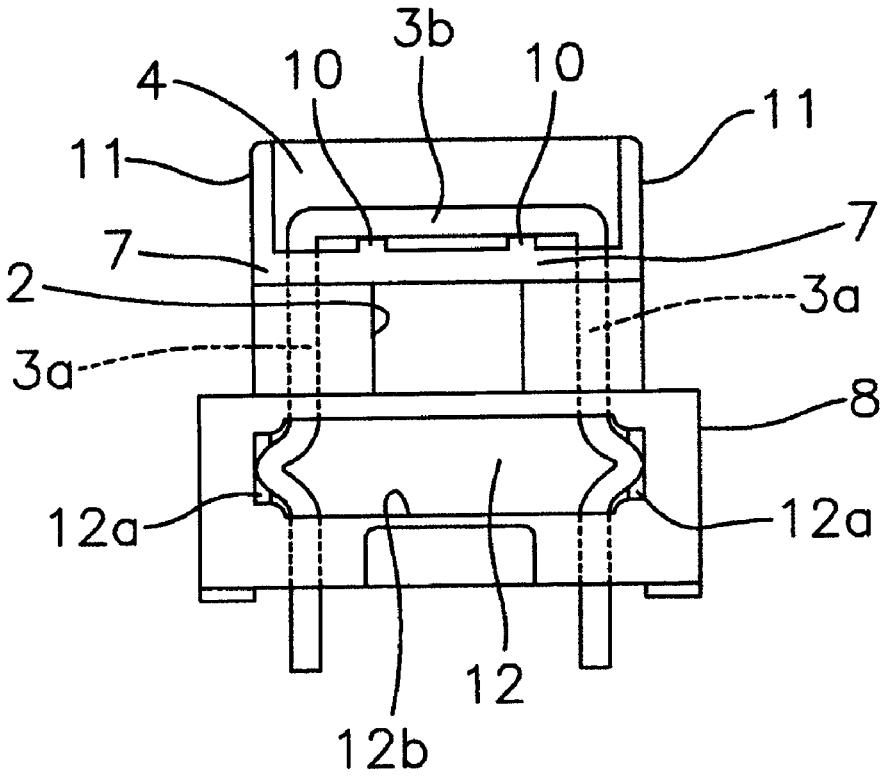
FIG. 4 is a front view showing the first embodiment of the present invention in its assembled condition.

FIG. 1 is a perspective view showing an embodiment of a coil bobbin for a current transformer according to the present invention, FIG. 2 is a side view, FIG. 3 is a front view before mounting a primary coil and FIG. 4 is a front view after mounting a primary coil.

The coil bobbin 1 is formed from insulative resinous molded component. The coil bobbin 1 is provided with a cylindrical or rectangular winding drum 2 around which a secondary coil (not shown) is wound, a first flange 4 formed at one end of the winding drum 2, to which the primary coil 3 is mounted, and a second flange 6 having pin terminals 5 formed at the other end of the winding drum 2.

A primary coil 3 is formed from a thick CP wire or a copper wire to form substantially U-shape as a whole. The primary coil 3 has the pair of legs 3*a* and a connection 3*b* for connecting them.

The first flange 4 is provided, at its outer upper portion, with a primary coil mounting portion 7 so as to protrude outwardly.

A primary coil fixing portion 8 is formed at a lower portion of the first flange 4, spaced from the primary coil mounting portion 7.

Part of the flange 4 between the primary coil mounting portion 7 and the primary coil fixing portion 8 is formed to be thick. The primary coil mounting portion 7 is formed, at both sides of its top surface, with a pair of through holes 9 extending from the primary coil mounting portion 7 toward the primary coil fixing portion 8.

Each leg 3*a* of the primary coil 3 extends through each of the through holes 9.

The primary coil mounting portion 7 is formed, on its top surface, with a pair of lib-shape positioning members 10 abutting the connection 3*b* of the primary coil 3. The positioning members 10 are formed between the pair of through holes 9. Alternatively, only one positioning member may be formed on substantially a center of the top surface of the primary coil mounting portion 7.

At both ends of the primary coil mounting portion 7, tapered walls 11 are formed.

The primary coil fixing portion 8 is in a shape of a rectangular frame with long sideways, inside of which is formed with a rectangular window 12 for fixing a primary coil 3.

At each side surface of the window 12, a concave fixing portion 12*a* is formed for laterally bending the leg 3*a* of the primary coil 3 to be fixed thereto.

Further, at both sides of a bottom 12*b* of the window 12 of the primary coil fixing portion 8, through holes 9' are formed at the corresponding positions to the through holes 9, through which the legs 3*a* of the primary coil 3 extend.

Namely, each leg 3*a* of the primary coil 3 extends through the through hole 9 formed across the primary coil mounting portion 7 and the thick part of the flange 4 into the window 12 of the primary coil fixing portion 8, then is inserted into the through hole 9' at the bottom 12*b* of the primary coil fixing portion 8 so as to outwardly protrude at its lower end. In addition, the connection 3*b* of the primary coil 3 abuts the positioning members 10 formed on the top surface of the primary coil mounting portion 7.

Each leg 3*a* in the window 12 is laterally bent toward the fixing portion 12*a* by a jig externally inserted into the window 12. This prevents the primary coil 3 from coming off upwardly so that the primary coil 3 is fixed to the coil bobbin 1.

Next, a method of fixing each leg 3*a* of the primary coil 3 will be described.

Figure 5:
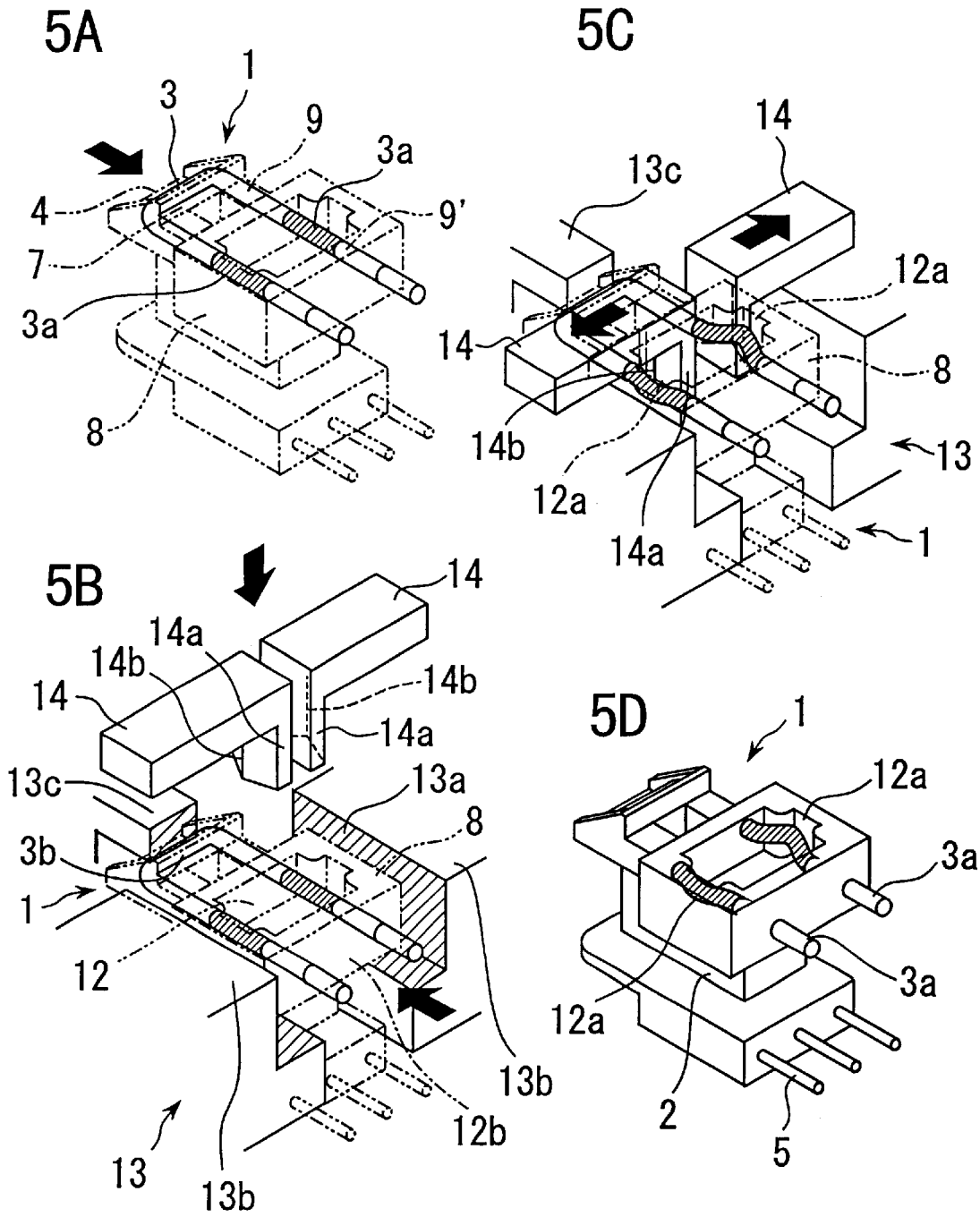
FIGS. 5A to 5D are views showing an assembly process of a coil bobbin for a current transformer according to the first embodiment of the present invention.

FIGS. 5A to 5D show a fixing process. In FIGS. 5A to 5C, the coil bobbin 1 is shown in phantom lines so as to clearly show the primary coil 3.

First, as shown in FIG. 5A, the primary coil 3 is mounted in such a manner that each leg 3*a* of the primary coil 3 is inserted as shown by an arrow into the primary coil mounting portion 7 and the primary coil fixing portion 8 of the first flange 4 of the coil bobbin 1.

Next, as shown in FIG. 5B, the coil bobbin 1 is arranged in a coil bobbin accommodating portion 13*a* of a fixing stand 13 for fixing the coil bobbin 1. The fixing stand 13 has a pair of holders 13*b* abutting the both side surfaces of the primary coil fixing portion 8 of the coil bobbin 1, and a holder 13*c* for holding the connection 3*b* of the primary coil 3. The coil bobbin accommodating portion 13*a* and the bent portion of each lea 3*a* of the primary coil 3 is hatched so as to be clearly shown.

Then, the coil bobbin 1 is fixed to the holder 13*c* for holding the connection 3*b*. To provide such a fixed relationship, for example, the coil bobbin 1 may be pressed by any pressing tool (not shown) with proper configuration, as shown by an arrow, from a side of the bottom 12*b* of the window 12 of the primary coil fixing portion 8. Alternatively, the primary coil fixing portion 8 may be tightly held, at its both side surfaces, by the holder 13*b* to be fixed.

In this condition, inserting portions 14*a* of a pair of jigs 14 in substantially L-shape as a whole are inserted into the window 12.

The tips of the jigs 14 are bent in substantially L-shape to form the inserting portions 14*a* inserted into the window 12. Substantially the center of the outer side surface of each bent portion 14*a* protrudes outwardly so as to form a protrusion 14*b* in substantially V-shape.

After each inserting portion 14*a* is inserted between each leg 3*a* of the window 12, the jig 14 is outwardly moved as shown by arrows in FIG. 5C so that part of each leg 3*a* can be bent in substantially V-shape by the V-shaped protrusion 14*b* at the outer side surface of the inserting portion 14*a*. The bent portion is fitted in the fixing portion 12*a* of the window 12 of the primary coil fixing portion 8, thereby permitting the primary coil 3 to be fixed thereto.

The jig 14 may be moved either automatically or manually.

Then, the jig 14 is moved upwardly, the inserting portion 14*a* is pulled out of the window 12, and the coil bobbin 1 is removed from the fixing stand 13. FIGS. 4 and 5D show this condition.

A current transformer is brought to completion by winding a secondary coil (not shown) around the winding drum 2 of the coil bobbin 1, as known, entwining its leading lines around pin terminals 5 and incorporating a core (not shown).

In using thereof, connecting each leg 3*a* of the primary coil 3 outwardly protruding from the coil bobbin 1 to a main circuit enables detecting output voltage corresponding to current flowing from the secondary coil to the main circuit.

Embodiment 2

Figure 6:
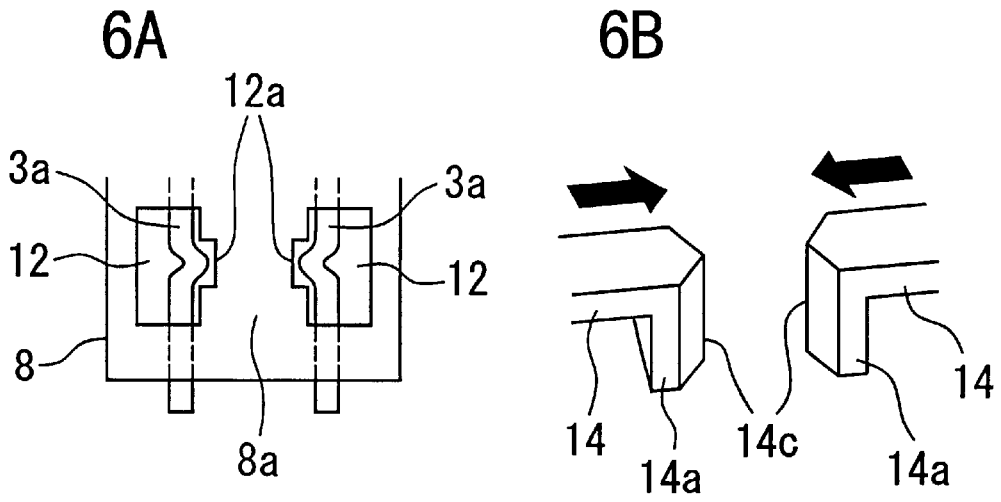
FIG. 6A is a front view of an important part of a second embodiment of the present invention.
FIG. 6B is a perspective view of jigs used in this embodiment.

FIG. 6 is a front view of an important part of a second embodiment of the present invention.

In this embodiment, a column 8*a* is formed at the center of the window 12 of the primary coil fixing portion 8 formed on the coil bobbin 1. Each outer side surface of the column 8*a* is inwardly formed with a concave fixing portion 12*a*.

In this embodiment, a pair of jigs 14 are used as shown in FIG. 6B. Each inserting portion 14*a* of the jigs 14 inwardly protrudes at the center of its inner side surface to form substantially a V-shape protrusion 14*c*.

Each leg 3*a* inserted into the window 12 is bent in substantially V-shape by the protrusion 14*c* when the inserting portion 14*a* of the inserted jig 14 is urged in a direction shown by an arrow in FIG. 6B. Then, as shown in FIG. 6A, the bent portion is fitted in the fixing portion 12*a* so as to fix the leg 3*a*.

The other configuration in the coil bobbin 1 is the same as that of the above described first embodiment.

Embodiment 3

Figure 7:
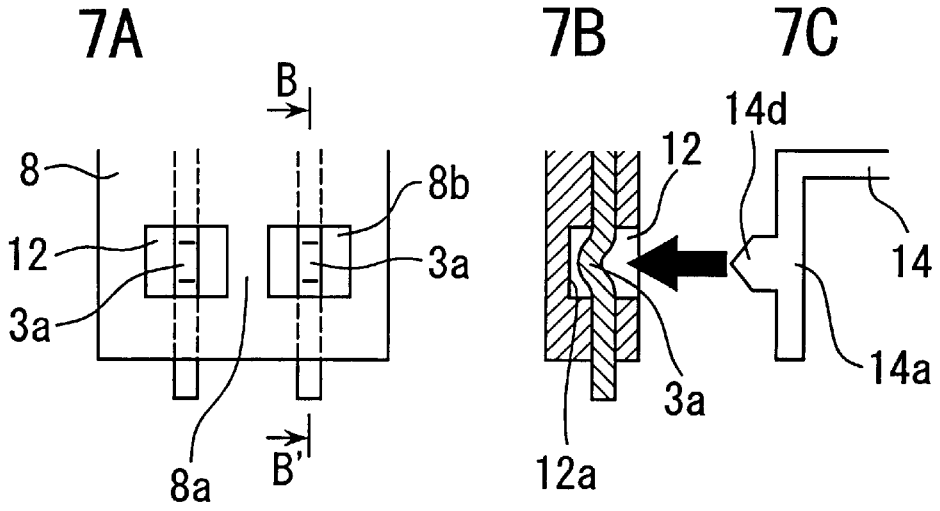
FIG. 7A is a front view of an important part of a third embodiment of the present invention.
FIG. 7B is a sectional view in line B–B' of FIG. 7A.
FIG. 7C is a side view of a jig used in this embodiment.
Figure 8:
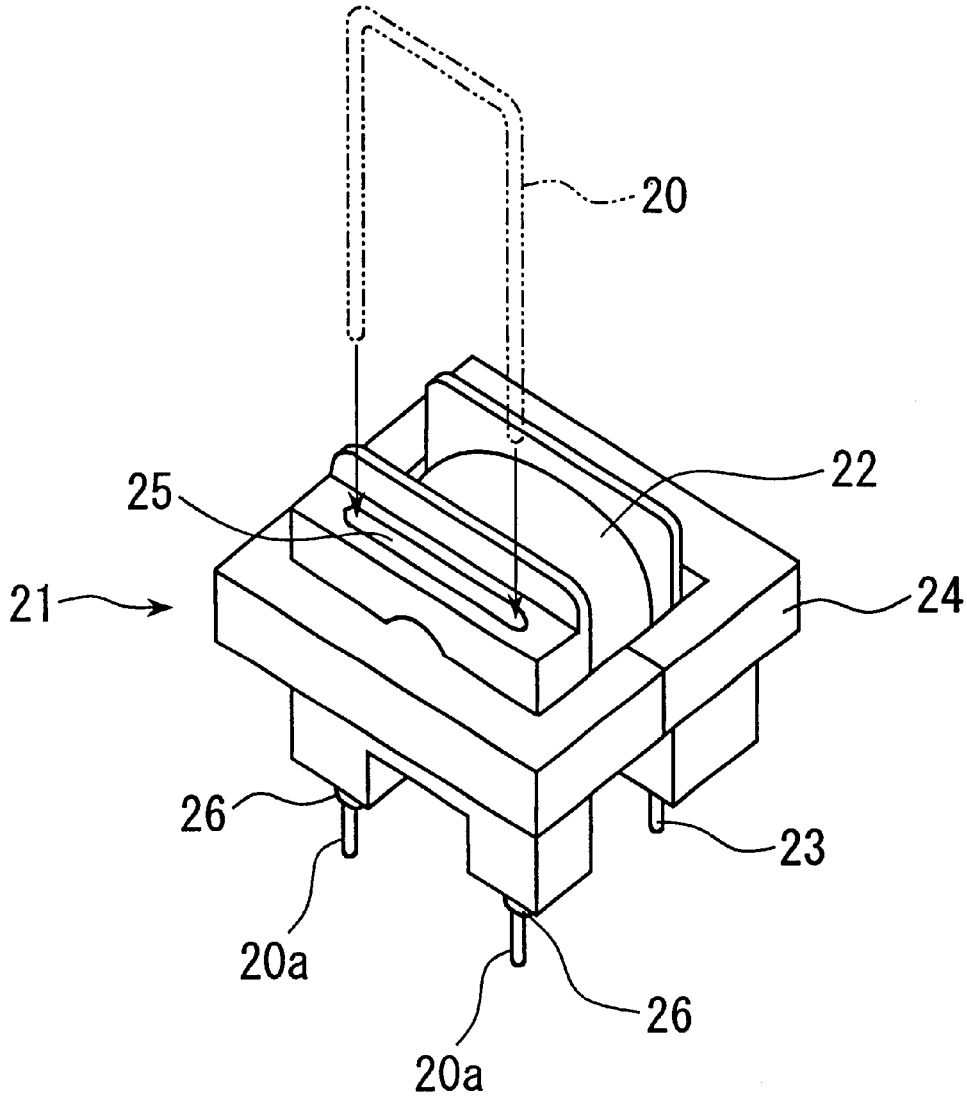
FIG. 8 PRIOR ART
FIG. 8 is a perspective view showing a conventional example.

FIG. 7A is a front view of an important part of a third embodiment of the present invention, FIG. 7B is a sectional view in line B–B' of FIG. 7A, FIG. 7C is a side view of a jig used in this embodiment.

In this embodiment, as shown in FIGS. 7A and 7B, the primary coil fixing portion 8 is formed with a concave fixing portion 12*a* at its inner wall 8*b*. In the Figure, the numeral 8*a* denotes a column formed at the center of the window 12, however, this column 8*a* is not essential to this embodiment.

As shown in FIG. 7C, the inserting portion 14*a* of the jig 14 is formed, at a part of its outer surface, with a protrusion 14*d* having a tip in substantially V-shape. Inserting the inserting portion 14*a* into the window 12 and urging it in an arrow direction enables bending part of each leg 3*a* to be fitted in and fixed to the fixing portion 12*a*.

The other configuration in the coil bobbin 1 is the same as that of the above described first embodiment.

As described above, according to the present invention, the first flange 4 of the coil bobbin 1 is formed with the primary coil mounting portion 7 and the primary coil fixing portion having the window 12 for inserting and mounting the primary coil 3, where the primary coil 3 is inserted. Then, the pair of legs 3*a* of the primary coil 3 positioned in the window 12 are bent by using the jig 14 SO that the bent portions are positioned in the concave fixing portions 12*a* formed on the window 12 to be fixed thereto. This requires no adhesive, no eyelet, or no extra cost for them, as well as permits easy fixing of the primary coil 3 to the coil bobbin 1.

In addition, the fixing portion 12*a* is formed on the both side surfaces, the center, or the inner wall surfaces of the window 12 so that each leg 3*a* is urged to be bent by the externally inserted jig 14, and that the bent portion is easily positioned in the fixing portion 12*a*, thereby obtaining good workability.

Furthermore, the jig 14 may have a simplified configuration such as formed with the protrusion 14*b*, 14*c* or 14*d* urging each leg 3*a*, and can be repeatedly used, which restrains an increase in cost.

What is claimed is:

1. A coil bobbin for a current transformer, wherein:

a coil bobbin (1) is formed, at an outer surface of one of flanges (4) thereof, with a primary coil mounting portion (7) and a primary coil fixing portion (8) so as to protrude outwardly;

said primary coil mounting portion (7) and said primary coil fixing portion (8) are formed, at both sides thereof, with through holes (9, 9') through which a pair of legs (3*a*) of a primary coil 3 for detecting electric current extend, said primary coil fixing portion (8) is formed with a window (12) into which at least one jig is inserted, and a top of said at least one jig (14) is bent in substantially L-shape, a protrusion (14*b*, 14*c*, 14*d*) is formed at the bent portion (14*a*), the protrusion (14*b*, 14*c*, 14*d*) being formed substantially V-shape;

said window (12) is formed with concave fixing portions (12*a*);

each of the legs (3*a*) of said primary coil (3) is inserted into each of said through holes (9) of said primary coil mounting portion (7), said window (12) and each of said through holes (9') of said primary coil fixing portion (8), respectively; and each of said legs (3*a*) positioned in said window (12) is urged to be bent by said protrusion (14*b*, 14*c*, 14*d*) of said jig (14) toward each of said fixing portions (12*a*) to be fixed thereto.

2. The coil bobbin for a current transformer according to claim 1, wherein said fixing portions (12*a*) are formed at both side surfaces of said window (12).

3. The coil bobbin for a current transformer according to claim 1, wherein said window (12) is formed, at a center thereof, with a column (8*a*), which is formed, at both side surfaces thereof, with said fixing portions (12*a*).

4. The coil bobbin for a current transformer according to claim 1, wherein said primary coil fixing portion (8) having said window (12) is formed, at an inner surface thereof, with said fixing portions (12*a*).

5. A coil bobbin for a current transformer, wherein:

a coil bobbin (1) is formed, at an outer surface of one of flanges (4) thereof, with a primary coil mounting portion (7) and a primary coil fixing portion (8) so as to protrude outwardly;

said primary coil mounting portion (7) and said primary coil fixing portion (8) are formed, at both sides thereof, with through holes (9, 9') through which a pair of legs (3*a*) of a primary coil (3) for detecting electric current extend;

said primary coil mounting portion (7) is formed, at a top surface thereof, with at least one positioning member (10) for positioning said primary coil (3), and a wall (11) is formed at each of both ends of said primary coil mounting portion (7);

said primary coil fixing portion (8) is formed with a window (12) into which at least one jig (14) is inserted, and a top of said at least one jig (14) is bent in substantially L-shape, a protrusion (14*b*, 14*c*, 14*d*) is formed at the bent portion (14*a*), the protrusion (14*b*, 14*c*, 14*d*) being formed in substantially V-shape;

said window (12) is formed with concave fixing portions (12*a*);

each of the legs (3*a*) of said primary coil (3) is inserted into each of said through holes (9) of said primary coil mounting portion (7), said window (12) and said through holes (9') of said primary coil fixing portion (8), respectively; and each of said legs (3*a*) positioned in said window (12) is urged to be bent by said protrusion (14*b*, 14*c*, 14*d*) of said jig (14) toward each of said fixing portions (12*a*) to be fixed thereto.

6. The coil bobbin for a current transformer according to claim 5, wherein said fixing portions (12*a*) are formed at both side surfaces of said window (12).

7. The coil bobbin for a current transformer according to claim 5, wherein said window (12) is formed, at a center thereof, with a column (8*a*), which is formed, at both side surfaces thereof, with said fixing portions (12*a*).

8. The coil bobbin for a current transformer according to claim 5, wherein said primary coil fixing portion (8) having said window (12) is formed, at an inner surface thereof, with said fixing portions (12*a*).

* * * * *

UNITED STATES PATENT AND TRADEMARK OFFICE

CERTIFICATE OF CORRECTION

PATENT NO. : 6,507,261 B1
DATED : January 14, 2003
INVENTOR(S) : Yuji Haga et al.

It is certified that error appears in the above-identified patent and that said Letters Patent is hereby corrected as shown below:

Column 3,
Line 25, replace “lib-shape” with -- rib-shape --.

Column 4,
Line 10, replace “lea” with -- leg --.

Signed and Sealed this

Eleventh Day of March, 2003

JAMES E. ROGAN
*Director of the United States Patent and Trademark Office*